US006122835A

United States Patent [19]

Khanyutin

[11] Patent Number: 6,122,835

[45] Date of Patent: Sep. 26, 2000

[54] DEVICE FOR CLEANING AIR FROM CLOTHES DRYER, AND CLOTHES DRYER PROVIDED THEREWITH

[76] Inventor: Arkadiy Khanyutin, 1060 Ocean Ave., #F9 Brooklyn, N.Y. 11226

[21] Appl. No.: 09/314,186

[22] Filed: May 19, 1999

[51] Int. Cl.[7] ..... F26B 21/06

[52] U.S. Cl. ..... 34/79; 34/82; 34/72

[58] Field of Search ..... 34/60, 63, 72, 34/79, 82, 85, 235; 454/359; 55/244

[56] References Cited

U.S. PATENT DOCUMENTS

| | | | |
|---|---|---|---|
| 2,825,148 | 3/1958 | Olson | 34/75 |
| 2,838,845 | 6/1958 | Erickson | 34/45 |
| 3,132,005 | 5/1964 | McMillan | 34/54 |
| 4,115,485 | 9/1978 | Genessi | 261/119 |
| 4,969,276 | 11/1990 | Walsh | 34/90 |
| 5,628,122 | 5/1997 | Spinardi | 34/79 |

*Primary Examiner*—Denise L. Ferensic
*Assistant Examiner*—Michelle A Mattera
*Attorney, Agent, or Firm*—I. Zborovsky

[57] ABSTRACT

A device for cleaning exhaust air from clothes dryers has a housing, an element for connecting an interior of the housing with an outlet of a clothes dryer so as to supply in the interior of the housing air exiting the clothes dryer and containing impurities, an element for supplying liquid into the interior of the housing so that the impurities are washed off from the air by the liquid and entrained in the liquid, an element for withdrawing air after washing off from the impurities from the housing, and an element for withdrawing the liquid with entrained impurities from the housing.

14 Claims, 2 Drawing Sheets

DEVICE FOR CLEANING AIR FROM CLOTHES DRYER, AND CLOTHES DRYER PROVIDED THEREWITH

BACKGROUND OF THE INVENTION

The present invention relates to clothes dryers.

It is known that during operation of clothes dryer, great quantities of dirt, such as lint is accumulated inside the dryer and in a ventilation system. If it Is not removed timely, this leads to abnormal operation of the dryer, increase of time of drying, excessive gas consumption, breakages, and sometimes burning of the dust and even fibers Also, during operation of the dryer a great quantity of dust as well as carbon dioxide (when it operates on gas) are discharged into the atmosphere through the ventilation system.

SUMMARY OF THE INVENTION

Accordingly, it is an object of the present invention to provide a clothes dryer which avoids the disadvantages of the prior art.

In keeping with these objects and with others which will become apparent hereinafter, one feature of present invention resides, briefly stated in a device for cleaning air discharged by a clothes dryer which has a housing; means for connecting an interior of said housing with an outlet of a clothes dryer so as to supply in the interior of said housing air exiting the clothes dryer and containing impurities; means for supplying liquid into the interior of said housing so that the impurities are washed from the air by the liquid and entrained in the liquid; means for withdrawing air after washing off the impurities, from said housing; and means for withdrawing the liquid with entrained impurities from said housing.

It is another feature of present invention to provide a clothes dryer with a clothes dryer device having a container for accommodating clothes with means for supplying a heated air into an interior of said container and means for withdrawing air from said drying device, and a device for cleaning air supplied from said clothes drying device, with cleaning device including a housing, means for connecting an interior of said housing with an outlet of a clothes dryer so as to supply in the interior of said housing air exiting the clothes dryer and containing impurities, means for supplying liquid into the interior of said housing so that the impurities are washed from the air by the liquid and entrained in the liquid, means for withdrawing air after washing from the impurities, from said housing, and means for withdrawing the liquid with entrained impurities from said housing.

When the clothes dryer is designed in accordance with the present invention and is provided with cleaning device, it avoids the disadvantages of the prior art.

Dirt, dust, lint no longer accumulate inside the dryer and therefore it is not necessary to provide a manual cleaning inside the dryer. It is no longer necessary to provide an aspiration ventilation and its periodical cleaning from dust and dirt. Also, a normal operation of a burner is provided by supply of additional air to the combustion zone or oxygen from the cleaning device.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
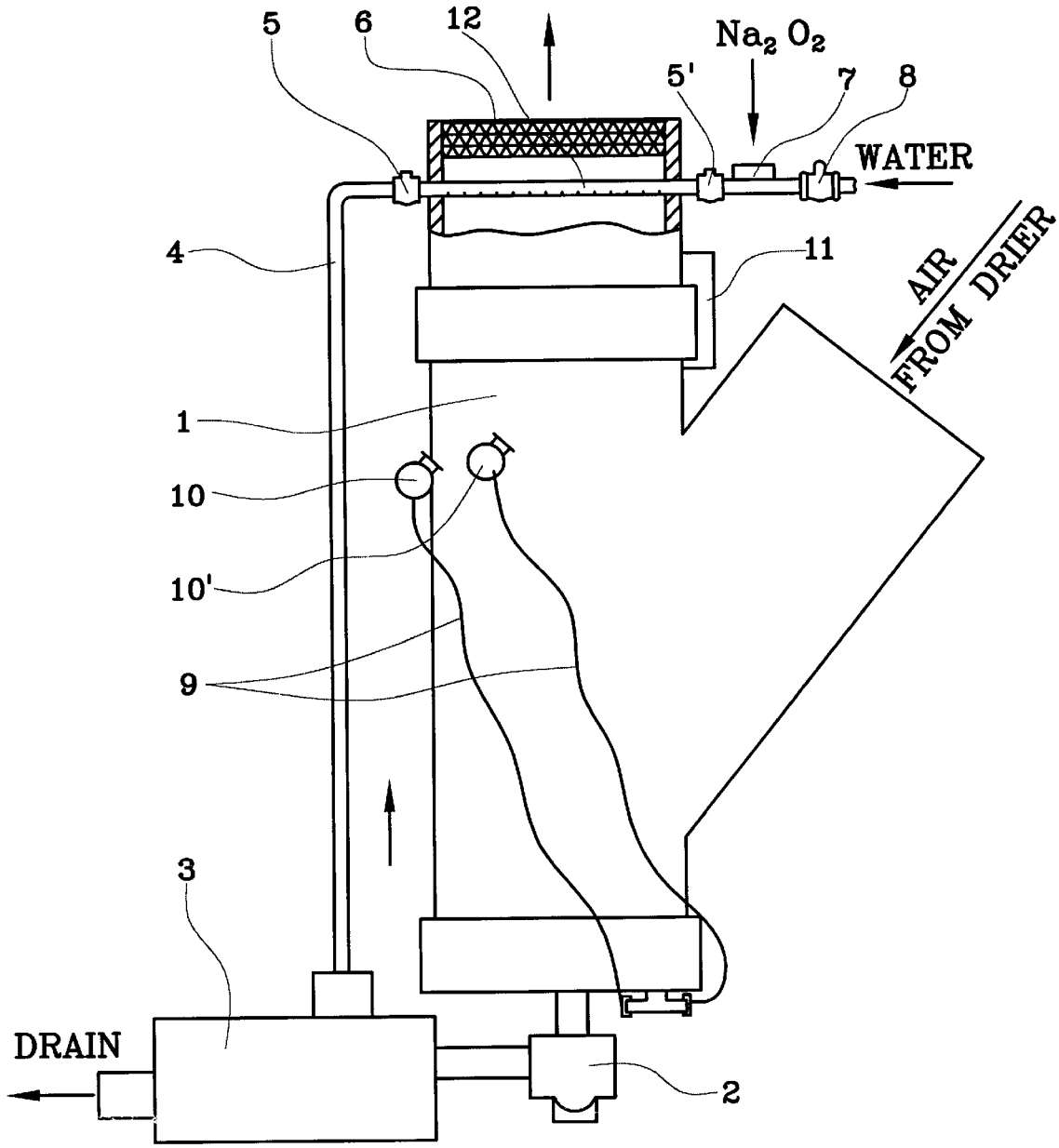
FIG. 1 is a view showing a device for cleaning air supplied from a clothes dryer in accordance with the present invention.

A device for cleaning air supplied from a clothes dryer and connected with the clothes dryer is shown in FIG. 1. The device has a housing which is identified as a whole with reference numeral 1. A pump 2 aspirates a medium from the interior of the housing 1 and supplies it through a two-way valve 3 either to a drainage or to a recirculation through a bypass pipe 4 and a check valve 5 into a liquid distributing element 12 which is formed as a pipe provided with a plurality of slots. Another check valve 5' is located at the opposite side of the housing.

A device for supplying a chemical substance, for example $Na_2O_2$ is identified with reference numeral 7. A water valve 8 is identified with reference numeral 8. The water valve 8, the device 7, and the check valve 5 are arranged in a water supply pipe for example from a source of water. Reference numeral 9 identifies pneumatic pipes which are connected with water level sensors formed for example as elements which are subjected to the pressure of a water column in the interior of the housing 1 and transmitting pneumatic signals to two level switches 10 and 10'. The level sensors are formed so that they sense two different water column sizes and therefore different water levels in the interior of the housing 1. Finally, the device is provided with an electronic control block 11.

Reference numeral 6 identifies a filtering element which can be formed for example as a mass of wool composed of intertwined metal or plastic wires so as to prevent passage of water droplets through it and permit passage of air.

The device operates in the following manner. Simultaneously with turning on of the clothes dryer, a signal is supplied to the control block 11. The latter opens the water valve 8, turns on the pump 2 and switches the two-way valve 3 so that a discharge of the liquid from it is blocked and the liquid can be supplied into the bypass pipe 4. The housing 1 is filled with water through the slotted pipe 12. Simultaneous $Na_2O_2$ is supplied into the housing as well. The water fills the interior of the housing 1 until the desired level is sensed by one of the level sensors and a corresponding one of the switches 10, 10' turns off the water valve 8 so as to close the latter. If one of the level sensors fails, then the second level sensor senses another, higher level of water, and the corresponding switch 10, 10' sends a signal to the two-way valve 3. The latter opens for passage of the liquid from the interior of the housing 1 into the drainage.

During the normal operation of the device, air with impurities, such as dust, dirt, lint is supplied into the interior of the housing 1, and mixed with water supplied by the slotted pipe 12 under the action of a "rain effect". The liquid with the impurities is recirculated by the pump 2 through the pipe 4 back into the interior of the housing 1. The second check valve 5 which is located in the water inlet pipe after the water valve 8 prevents entry of the water contaminated with impurities back into the water supply. The air which is supplied into the interior of the housing 1 and cleaned in It leaves the housing through the upper outlet and passes through the filtering element 6 which prevents water droplets from passing through it but permits air to pass through it. When $Na_2O_2$ is also supplied into the interior of the housing, the following chemical reaction takes place:

$$2Na_2O_2+2\ Co_2=2\ Na_2Co_3+O_2$$

Figure 2:
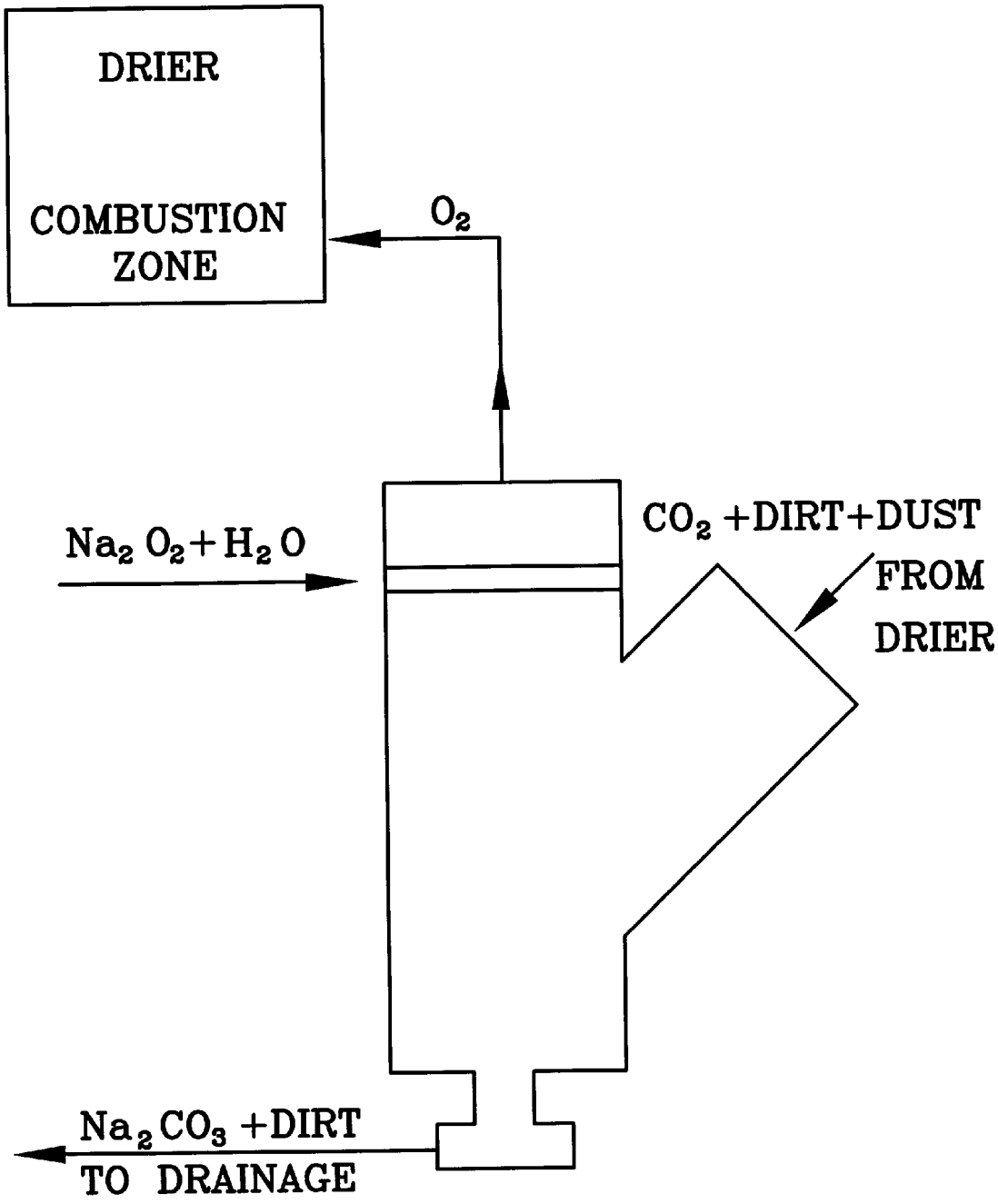
FIG. 2 is a view schematically showing a clothes dryer provided with the inventive cleaning device.

In other words, the carbon dioxide which is supplied with the air from the cloth dryer is converted into oxygen. The oxygen is then supplied into a combustion zone of the clothes dryer as shown in FIG. 2.

At a certain point, the control block 11 sends a signal to the two-way valve 3 and the water with the impurities is drained through the valve 3 to a drainage. This signal can be supplied to the two-way valve 3 when for example the clothes dryer stops drying the clothes. Naturally, it can be supplied also by an operator at any given time when he feels that the water is too contaminated.

When the level of water is lowered, the sensor sends a signal to open the water valve 8, water is supplied into the housing and cleans it, and then leaves the housing through the valve 3. The duration of this process is controlled by the block 11 and can be adjusted, depending on the contamination of water.

It will be understood that each of the elements described above, or two or more together, may also find a useful application in other types of constructions differing from the types described above.

While the invention has been illustrated and described as embodied in device for cleaning air from clothes dryer, and clothes dryer provided therewith, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A device wherein said recirculating means include a recirculating conduit and a spraying element connected with said circulating conduit so as to receive the liquid with the impurities from the recirculating conduit and spray into the interior of said housing.

2. A device as defined in claim 1, and further comprising a filtering element located in said connecting means and performed so that it repels droplets of liquid back into the interior of said housing and allows free passage of the air from the interior of said housing to the combustion zone.

3. A device as defined in claim 1, wherein said recirculating means include a recirculating conduit and a spraying element connected with said circulating conduit so as to receive the liquid with the impurities from the recirculating conduit and spray into the interior of said housing.

4. A device as claimed in claim 1, and further comprising a filtering element located in said connecting means and performed so that it repels droplets of liquid back into the interior of said housing and allows free passage of the air from the interior of said housing to the combustion zone.

5. A device for cleaning exhaust air from clothes dryers, comprising a housing; means for connecting an interior of said housing with an outlet of a clothes dryer so as to supply in the interior of said housing air exiting the clothes dryer and containing impurities; means for supplying liquid into the interior of said housing so that the impurities are washed off from the air by the liquid and entrained in the liquid; means for withdrawing air after washing off from the impurities, from said housing; means for withdrawing the liquid with entrained impurities from said housing; and means for recirculating at least a portion of the liquid with the impurities withdrawn from said housing back into said housing.

6. A device for cleaning exhaust air from clothes dryers, comprising a housing; means for connecting an interior of said housing with an outlet of a clothes dryer so as to supply in the interior of said housing air exiting the clothes dryer and containing impurities; means for supplying liquid into the interior of said housing so that the impurities are washed off from the air by the liquid and entrained in the liquid; means for withdrawing air after washing off from the impurities, from said housing; means for withdrawing the liquid with entrained impurities from said housing; and means for connecting said means for withdrawing air from said housing to a combustion zone of the clothes dryer.

7. A device for cleaning exhaust air from clothes dryers, comprising a housing; means for connecting an interior of said housing with an outlet of a clothes dryer so as to supply in the interior of said housing air exiting the clothes dryer and containing impurities; means for supplying liquid into the interior of said housing so that the impurities are washed off from the air by the liquid and entrained in the liquid; means for withdrawing air after washing off from the impurities, from said housing; means for withdrawing the liquid with entrained impurities from said housing; and means for sensing a level of the liquid in the interior of said housing and stopping a liquid supply when a desired level of the liquid in the housing is obtained.

8. A device for cleaning exhaust air from clothes dryers, comprising a housing; means for connecting an interior of said housing with an outlet of a clothes dryer so as to supply in the interior of said housing air exiting the clothes dryer and containing impurities; means for supplying liquid into the interior of said housing so that the impurities are washed off from the air by the liquid and entrained in the liquid; means for withdrawing air after washing off from the impurities, from said housing; means for withdrawing the liquid with entrained impurities from said housing; and means for supplying a substance into the interior of said housing so that said substance reacts with $CO_2$ of the air supplied from the clothes dryer to produce oxygen; and means for connecting said means for withdrawing air with the combustion zone of the clothes dryer so that the oxygen is supplied into the combustion zone of the clothes dryer through said connecting means.

9. A device for cleaning exhaust air from clothes dryers, comprising a housing; means for connecting an interior of said housing with an outlet of a clothes dryer so as to supply in the interior of said housing air exiting the clothes dryer and containing impurities; means for supplying liquid into the interior of said housing so that the impurities are washed off from the air by the liquid and entrained in the liquid; means for withdrawing air after washing off from the impurities, from said housing; means for withdrawing the liquid with entrained impurities from said housing; and means for sensing a level of the liquid in the interior of said housing and stopping the supply of liquid into the housing when a level of the liquid in said housing exceeds a predetermined level; and additional level sensing means which sense a somewhat higher level, so that when said first level sensing means is inoperative, said additional sensing means senses a higher level of the liquid in the interior of said housing and activates immediate withdrawal of the liquid with impurities from the interior of said housing.

10. A clothes dryer, comprising a clothes drying device having a container for accommodating clothes with means for supplying heated air into an interior of said container and means for withdrawing air from the drying device; and a device for cleaning air supplied from said clothes drying device, said drying device including a housing; means for connecting an interior of said housing with an outlet of a clothes dryer so as to supply in the interior of said housing air exiting the clothes dryer and containing impurities; means for supplying liquid into the interior of said housing so that the impurities are washed off from the air by the liquid and entrained in the liquid; means for withdrawing air after washing off from the impurities, from said housing; means for withdrawing the liquid with entrained impurities from said housing; and means for recirculating at least a portion of the liquid with the impurities withdrawn from said housing, back into said housing.

11. A clothes dryer, comprising a clothes drying device having a container for accommodating clothes with means for supplying heated air into an interior of said container and means for withdrawing air from the drying device; and a device for cleaning air supplied from said clothes drying device, said drying device including a housing; means for connecting an interior of said housing with an outlet of a clothes dryer so as to supply in the interior of said housing air exiting the clothes dryer and containing impurities; means for supplying liquid into the interior of said housing so that the impurities are washed off from the air by the liquid and entrained in the liquid; means for withdrawing air after washing off from the impurities, from said housing, means for withdrawing the liquid with entrained impurities from said housing; and means for connecting said means for withdrawing air from said housing to a combustion zone of the clothes dryer.

12. A clothes dryer, comprising a clothes drying device having a container for accommodating clothes with means for supplying heated air into an interior of said container and means for withdrawing air from the drying device; and a device for cleaning air supplied from said clothes drying device, said drying device including a housing; means for connecting an interior of said housing with an outlet of a clothes dryer so as to supply in the interior of said housing air exiting the clothes dryer and containing impurities; means for supplying liquid into the interior of said housing so that the impurities are washed off from the air by the liquid and entrained in the liquid; means for withdrawing air after washing off from the impurities, from said housing; means for withdrawing the liquid with entrained impurities from said housing; and means for sensing a level of the liquid in the interior of said housing and stopping a liquid supply when a desired level of the liquid in said housing is obtained.

13. A clothes dryer, comprising a clothes drying device having a container for accommodating clothes with means for supplying heated air into an interior of said container and means for withdrawing air from the drying device; and a device for cleaning air supplied from said clothes drying device, said drying device including a housing; means for connecting an interior of said housing with an outlet of a clothes dryer so as to supply in the interior of said housing air exiting the clothes dryer and containing impurities; means for supplying liquid into the interior of said housing so that the impurities are washed off from the air by the liquid and entrained in the liquid; means for withdrawing air after washing off from the impurities, from said housing; means for withdrawing the liquid with entrained impurities from said housing; and means for supplying a substance into the interior of said housing so that said substance reacts with $CO_2$ of the air supplied from the clothes dryer to produce oxygen; and means for connecting said means for withdrawing air with the combustion zone of the clothes dryer so that the oxygen is supplied into the combustion zone of the clothes dryer through said connecting means.

14. A clothes dryer, comprising a clothes drying device having a container for accommodating clothes with means for supplying heated air into an interior of said container and means for withdrawing air from the drying device; and a device for cleaning air supplied from said clothes drying device, said drying device including a housing; means for connecting an interior of said housing with an outlet of a clothes dryer so as to supply in the interior of said housing air exiting the clothes dryer and containing impurities; means for supplying liquid into the interior of said housing so that the impurities are washed off from the air by the liquid and entrained in the liquid; means for withdrawing air after washing off from the impurities, from said housing; means for withdrawing the liquid with entrained impurities from said housing; and means for sensing a level of the liquid in the interior of said housing and stopping the supply of liquid into the housing when a level of the liquid in said housing exceeds a predetermined level; and additional level sensing means which sense a somewhat higher level, so that when said first level sensing means is inoperative, said additional sensing means senses a higher level of the liquid in the interior of said housing and activates immediate withdrawal of the liquid with impurities from the interior of said housing.

* * * * *